United States Patent [19]

Wood et al.

[11] 4,396,230

[45] Aug. 2, 1983

[54] MULTIPLE BRANCH WELL CONTAINING ONE PRODUCER AND ONE INJECTOR WELL

[76] Inventors: Edward T. Wood, 3415 Fawn Creek, Kingwood, Tex. 77339; Donald W. Dareing, 13914 Jaycreek Ct., Houston, Tex. 77070; William C. Larson, 8301 Ewing Rd., Bloomington, Minn. 55431; Robert Snyder, 2010 Grove Lake Dr., Kingwood, Tex. 77339

[21] Appl. No.: 276,552

[22] Filed: Jun. 23, 1981

[51] Int. Cl.[3] ..... E21B 43/28

[52] U.S. Cl. ..... 299/4; 166/106; 166/313; 166/371; 166/5

[58] Field of Search ..... 299/4.5; 166/268, 306, 166/106, 105, 68, 313, 369, 371

[56] References Cited

U.S. PATENT DOCUMENTS

| | | | |
|---|---|---|---|
| 3,126,965 | 3/1964 | Lindsey | 166/68 |
| 3,161,140 | 12/1964 | Bloudoff | 166/68 |
| 3,559,740 | 2/1971 | Scaggs | 166/313 |
| 3,833,060 | 9/1974 | Craggs et al. | 166/68 |
| 4,125,289 | 11/1978 | Huff et al. | 299/4 |
| 4,200,152 | 4/1980 | Foster et al. | 299/4 X |
| 4,222,611 | 9/1980 | Larson et al. | 166/268 X |
| 4,249,777 | 2/1981 | Morrell et al. | 166/245 X |
| 4,279,301 | 7/1981 | Williams | 175/61 |

*Primary Examiner*—Stephen J. Novosad

*Attorney, Agent, or Firm*—Thomas Zack; Donald A. Gardiner

[57] ABSTRACT

A multiple branch well for use with in situ leach mining of deep lying ore bodies. The branch wells may be formed by a method disclosed in a related invention. Each well may have two branches one of which is a producer well and one an injector well. Internally of the main casing from which the two branch casings extend are—from the lower end up—a packer unit, a tubing hanger, and a wireline retrievable hydraulically generated pump. The packer and tubing hanger serve their conventional function of, respectively, blocking the flow of leach fluids and holding the branch tubular casing in place within the main casing. The hydraulic pump joins the tubular casings to maintain a constant ratio of produced fluid to injected fluid. This pump is operated by a pressurized fluid source. Since it is retrievable and hydraulically operated, the pump can be brought to the surface for any repairs or maintenance and it requires less surface plumbing with no down hole electrical power.

6 Claims, 1 Drawing Figure

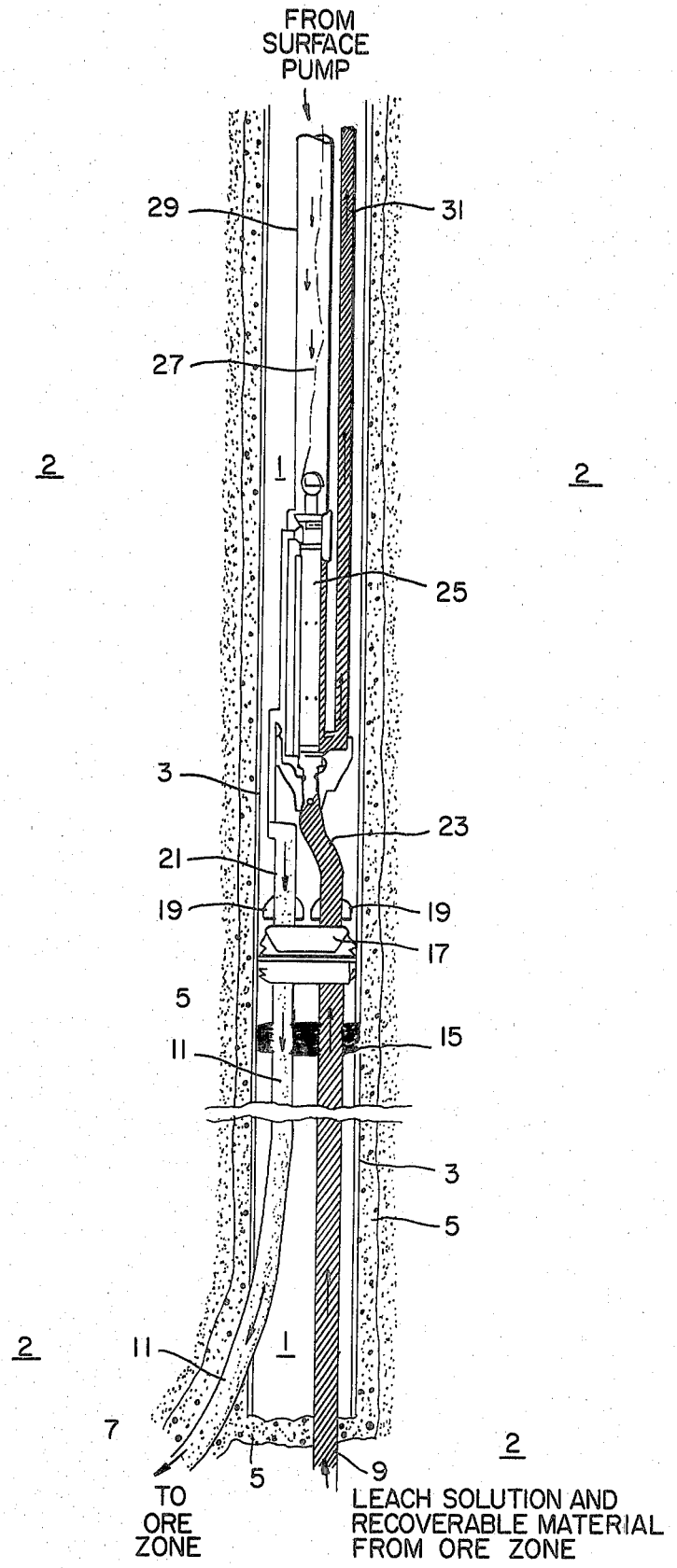
FROM
SURFACE
PUMP
29
31
27
2
1
2
25
3
23
21
19
19
17
5
15
11
3
5
2
11
1
7
2
5
9
TO
ORE
ZONE
LEACH SOLUTION AND
RECOVERABLE MATERIAL
FROM ORE ZONE

MULTIPLE BRANCH WELL CONTAINING ONE PRODUCER AND ONE INJECTOR WELL

BACKGROUND OF THE INVENTION

1. Field of the Invention

Multiple branch wells used to inject and recover a leach solution and minerals from the same common casing.

2. Description of the Prior Art

Multiple branch wells from a common generally vertical main casing are disclosed in the prior in situ leach mining art as evidenced by the U.S. Pat. No. 4,222,611 and 4,249,777, both to W. C. Larson et al and assigned to the same assignee as herein. The former invention is of particular relevancy to this invention. However, many of the specific methods used to form the branch wells of the preferred embodiment of this invention are not disclosed in these two earlier patents. The methods can be found in a copending U.S. patent application Ser. No. 276,551 filed June 23, 1981, entitled "Multiple Branch Completion with Common Drilling and Casing Template" by the same inventive entity as here. The contents of this last mentioned invention and what is being disclosed and claimed here, as well as other related inventions, were first publically disclosed on Jan. 18–22, 1981, at the ASME Petroleum Division Meeting in Houston, Tex. A handout thereat entitled "Drilling and Completing Multiple Branched Boreholes" is incorporated by reference herein. All of the work described in this handout was done under a contract between the U.S. Department of the Interior, Bureau of Mines, and Maurer Engineering Inc., of Houston, Tex. The final contract report dated July 1980 was first released to the public by the U.S. Bureau of Mines in January 1981.

The closest known prior art to what is being disclosed and claimed herein is the mentioned U.S. Pat. No. 4,222,611. Therein two branch wells are whipstocked from a hole to form a combined injection and recovery main generally vertical well. One or both of these branch wells serve as injector wells and the main well serves as the recovery or producer well. At the lower end of the main well a conduit and pump are inserted to allow the leach solution with its mineral bearing material to be recovered to the surface. As disclosed in this patent (column 2, lines 56–66), a hollow drop pipe 15 with an electrically operated submersible pump 17 extends near or into the ore zone to provide for the recovery. This invention is an improvement of that previous lift system. Herein we utilize the fluid injected from pump on the surface as the source of power for a retrievable downhole hydraulically operated positive displacement pump. This has many advantages over the electrically operated submersible pump which is fixed in its casing. It conserves casing cross-sectional space by putting pump in tandem with injection tubing, thus allowing injection or production from a single well head. The pump is wireline retrievable to allow surface repairs and/or maintenance to take place. Less surface plumbing is required with no downhole electrical power. And, because of its location and hook-up, the displacement pump maintains a constant ratio of produced fluid to injected fluid. All of these advantages provide the operational characteristics desired for an effective injection/recovery single well in situ leach mining system.

SUMMARY OF THE INVENTION

The apparatus described herein relates to a single injector/recovery well used with an in situ leach mining process. At least two branch wells extend from the lower end of a main casing of the main generally vertical well. Each of these branches are cased with flexible casing, such as with fiberglass tubing. One branch acts as the injection branch and the other as the recovery branch. Within the main casing above the branch wells is a wireline retrievable hydraulic pump. This pump connects to the two branch casings via a tubing hanger and packer at its lower end and the leach solution input and output at its upper end. Power to run the pump is supplied by hydraulic pump from the surface such that a constant ratio of produced fluid to injected fluid is maintained.

The primary object of this invention is an improved in situ leach mining system which employs a single injector/recovery well.

BRIEF DESCRIPTION OF THE DRAWING

The FIGURE is a schematic diagram of how the preferred embodiment of the invention would appear in a well.

DESCRIPTION OF THE PREFERRED EMBODIMENT

As pointed out in the description of the prior art, this invention interrelates with several other inventions. It is basically an improvement over the invention disclosed and claimed in U.S. Pat. No. 4,222,611. Thus, this invention presupposes some method, preferably those discussed, has been used to: drill the main vertical hole 1 in the earth (2), case (3), and cement (5) this hole; and drill, case and cement the two branch wells 7 and 9. Each of the branch wells is cased with a flexible fiberglass tubing. Set within the casing 3 near its lower end above where the branches extend therefrom is a packer 15. This packer would encircle the two branch casing tubes and would, except for flow in these tubes, block the flow of fluids in the main casing at this location. Above the packer in the same casing is the tubing hanger 17. It provides a mount to hold the branch casings ends with the main casing. Left hand safety connections 19, one for each of the hanger connecting conduits 21 and 23, function to connect the hanger to these conduits. Above these conduits is the retrievable hydraulic pump 25 which is connected to the surface via wireline 27 (shown in phantom line format). This pump is in turn in fluid communication with surface equipment (not shown) by way of leach fluid injection tube 29 and fluid producer (or recovery) tube 31. The earth's surface contains the necessary conventional equipment, including an hydraulic pump, to pump the leach solution down the hole 1 (via tube 29) in the earth 2.

In one embodiment the injection tube 29 was a $3\frac{1}{2}$ inch diameter fiberglass tube and the production tube 31 was a $2\frac{7}{8}$ inch diameter fiberglass production tube. The pump 25 was a KOBE (manufactured by the Kobe Company of Huntington Park, Calif.) Type E hydraulic bottom hole piston pump modified to resist corrosion. When connected to the $3\frac{1}{2}$ inch tubing, i.e., tubes 21, 23, and 29, and the smaller tubing 31, this pump can produce or recover 2,400 barrels (bbl) per day at 60% capacity with 2,100 bbl./day of injected fluid. The 300 extra bbl comes from ground water in the earth. It is estimated that when this system would be installed in a 2,000 foot branch well, it would require 1,350 feet of head pressure to lift the production fluid. This head pressure is about 1,300 psi injection pressure. The pump power required to inject 2,100 bbl./day at 1,300 psi is about 46.4 horsepower. In reality, operating parameters of the dual branch system would be in a dynamic state. Injection and production fluid pressures would vary due to the influence of adjacent wells and temporary changes in the effective permeability of the earth. However, the critical ratio of produced fluid to injection fluid will remain constant. In this example, the positive displacement pump will produce 14% more fluid than it injects, i.e., the total flow rate may vary but the ratio of produced fluid to injection fluid will not change. This is a characteristic of the pump which satisfies one of the operational requirements of in situ leaching, i.e., production must be greater than injection so as to prevent leach solution from migrating out of desired area.

Much of the conventional equipment that would be useable with a well such as that illustrated has not been shown. For example, the screens at the end of the branch well casings, the perforations in these branch casings, and the surface mineral recovery and pumping system. Also, many methods can be used to produce the branch wells such as the method disclosed in our copending patent application entitled "Multiple Branch Completion with Common Drilling and Casing Template" bearing Ser. No. 276,551 and filed on June 23, 1981. In addition, the individual injector/recovery wells with their multiple branches can be drilled into the earth to form a variety of patterns as stated in U.S. Pat. No. 4,222,611. For example, a 5 spot well pattern could be employed with each spot being a well as disclosed herein.

It is important to note that the downhole retrievable hydraulic pump we envision will be used with our invention uses the energy of injection of the leach solution from the surface pumping system to make it operate. It has few moving parts and uses a venturi effect for its operation. It is a double acting hydraulic piston pump made up of two vertically movable pistons joined by a rod. This movable rod is always in tension and never in compression. As the pistons and common rod move, ball valves function to control the exit and entrance of the hydraulic fluid. These valves are associated with piston chambers located on opposite sides of the pump. Thus, it is a simple, reliable, economical, downhole pump which can be retrieved in the remote event it malfunctions. This in turn insures a lower cost and more reliable operating in situ leach mining well to both inject a leach solution and recover the mineral desired. When the depth of the well we contemplate our invention will be used with (over 1,000 feet and most likely over 2,000 feet) is viewed along with our invention, it should be clear that its stated advantages have extremely practical importance.

Other benefits and embodiments of our invention other than those disclosed are possible. None of these should be used to limit or change the scope of our invention which is to be measured only by the claims which follow.

We claim:

1. A leach solution injection and mineral recovery well comprising:

a main cased well hole extending in a generally vertical direction deep into the earth, said casing extending substantially the entire depth of the hole;

at least two cased branch wells extending from the lower end of the main well casing into the ore body to be recovered, one of said branches functioning as a leach solution injection well branch and the other as a mineral recovery well branch;

a retrievable hydraulically operated pump mounted in said main well casing, said pump being operated by generated fluid pressure; and fluid conduit means for supplying the operating pressurized leach fluid to said pump from the surface and therefrom to said injector well branch, said means also providing for the return of recoverable minerals to said pump and therefrom to the surface.

2. The well of claim 1 also including a surface pump as the source for said pressurized leach fluid to the fluid conduit means which operates the pump mounted in the main well casing.

3. The well of claim 1 also including provision for retrieval and installation of said pump by use of a wireline extending from the surface.

4. The well of claim 1 wherein said fluid conduit means includes flexible fiberglass tubes in fluid communication with said pump, one of said tubes extending into the branch injector well and another of said tubes acting as the return branch well to convey recoverable minerals.

5. The well of claim 1 also including means for mounting the fluid conduit means to the main casing, and packer means mounted in said main casing below said mounting means and pump to block the flow of fluid.

6. The well of claim 1 wherein said pump maintains a constant ratio of the fluid produced to the fluid being injected therein, and said fluid conduit means between the surface and pump comprised two tubes of different diameters.

* * * * *